US005338009A

United States Patent [19]

Pielet et al.

[11] Patent Number: 5,338,009

[45] Date of Patent: Aug. 16, 1994

[54] TUNDISH FOR MOLTEN ALLOY CONTAINING DENSE, UNDISSOLVED ALLOYING INGREDIENT

[75] Inventors: Howard M. Pielet, Munster; William J. Kreevich, St. John; Masood A. Tindyala, Griffith; John R. Knoepke, Munster, all of Ind.

[73] Assignee: Inland Steel Company, Chicago, Ill.

[21] Appl. No.: 150,556

[22] Filed: Nov. 10, 1993

Related U.S. Application Data

[63] Continuation of Ser. No. 997,244, Dec. 28, 1992, abandoned.

[51] Int. Cl.[5] ..... B22D 37/00

[52] U.S. Cl. ..... 266/229; 266/275; 164/437

[58] Field of Search ..... 266/205, 227, 229, 275; 164/437, 335, 337; 222/591, 594

[56] References Cited

U.S. PATENT DOCUMENTS

| | | | |
|---|---|---|---|
| 4,671,499 | 6/1987 | Ishiyama et al. | 266/275 |
| 4,770,395 | 9/1988 | Vo Thanh et al. | 266/275 |
| 4,852,632 | 8/1989 | Jackson et al. | 164/437 |
| 4,942,986 | 7/1990 | Lewis et al. | 266/275 |

FOREIGN PATENT DOCUMENTS 62-92064 6/1987 Japan .

OTHER PUBLICATIONS

Howard M. Pielet, "Lead Drain Trials", Jan. 30, 1992, pp. 1-8.

*Primary Examiner*—Scott Kastler

*Attorney, Agent, or Firm*—Marshall, O'Toole, Gerstein, Murray & Borun

[57] ABSTRACT

A tundish has an entry location for receiving a molten alloy, such as steel, and bottom outlet openings for withdrawing the molten alloy. The tundish bottom comprises a sump located downstream of the inlet location and upstream of the outlet openings. Undissolved, molten alloying ingredient, denser than the molten alloy as whole, (e.g. lead or bismuth in the case of molten steel) accumulates in the sump. The sump has a floor and passageways which extend downwardly from the sump floor to a drain in the steel tundish shell underlying the sump. The passageways are permeable to undissolved, molten alloying ingredient but impermeable to the molten alloy. There are expedients for maintaining the passageways at a temperature which prevents undissolved alloying ingredient descending through the passageways from cooling to a temperature at which the undissolved alloying ingredient blocks the passageways against further passage by undissolved, molten alloying ingredient.

34 Claims, 3 Drawing Sheets

TUNDISH FOR MOLTEN ALLOY CONTAINING DENSE, UNDISSOLVED ALLOYING INGREDIENT

This is a continuation of U.S. application Ser. No. 07/997,244, filed Dec. 28, 1992, now abandoned.

BACKGROUND OF THE INVENTION

The present invention relates generally to tundishes used in the continuous casting of molten alloys, such as molten steel, and more particularly to a tundish constructed to control or direct the escape from the tundish of an undissolved, molten alloying ingredient denser than the molten alloy as a whole.

The following discussion is in the context of molten steel containing undissolved, molten lead and/or bismuth as the denser alloying ingredient. However, that particular steel is merely an example of one type of molten alloy with which the present invention is intended to be employed; the present invention may also be employed with other molten alloys having similar characteristics, e.g. a molten copper-based alloy containing undissolved, molten lead.

In the continuous casting of molten steel, a stream of molten steel is poured from a ladle into an intermediate vessel known as a tundish having a bottom containing outlet openings through which molten steel flows into a continuous casting mold. Molten steel is conventionally introduced into the tundish at an entry location spaced from each of the outlet openings, and the molten steel normally flows along the bottom of the tundish downstream from the entry location to an outlet opening.

Certain steels, known as free-machining steels, contain lead and/or bismuth to improve the machinability of the steel. Typical contents for each are about 0.04–0.40 wt. % bismuth and 0.05–0.50 wt. % lead. Lead and/or bismuth my be added to the stream of molten steel entering the tundish.

Lead and bismuth have a relatively low solubility in molten steel, compared to other alloying ingredients added to molten steel, and lead and bismuth are denser than molten steel. Because of these properties, substantial amounts of undissolved lead and bismuth tend to accumulate at the bottom of the tundish. If these accumulations of undissolved lead and bismuth are allowed to flow out through the outlet openings in the bottom of the tundish, they will do so as relatively large globules, and this will be manifest in the solidified steel as large, localized concentrations of lead or bismuth, which is undesirable.

Various expedients have been employed to cope with the problems described in the preceding paragraph. Many of these expedients are described in Jackson, et al. U.S. Pat. No. 4,852,632, issued Aug. 1, 1989, and the disclosure thereof is incorporated herein by reference. One such expedient comprises interposing a refractory dam between the tundish entry location and the tundish outlet opening. This dam extends upwardly from the vessel bottom and prevents undissolved, molten alloying ingredient which settles on the tundish bottom from moving downstream past the darn. As used hereinafter, the term "undissolved, molten alloying ingredient" refers to undissolved molten lead or bismuth or other elements having like properties.

Expedients which prevent undissolved, molten alloying ingredient from entering a tundish outlet opening result in the accumulation of large amounts of undissolved alloying ingredient on the vessel bottom at a location spaced upstream from the tundish outlet opening, and that too is undesirable.

One proposal for preventing large accumulations of undissolved alloying ingredient on the vessel bottom comprises providing, at the bottom of the tundish, a sump located between the entry location and the tundish outlet opening. This sump has a floor which is lower than the tundish bottom surrounding the sump. The relatively dense, undissolved molten alloying ingredient collects in or about the sump as a result of the difference in density between the undissolved molten alloying ingredient and the molten steel. The sump floor is composed of a refractory material which is impermeable to molten steel but is permeable to the undissolved, molten alloying ingredient. A drain is provided in the metal shell of the tundish underlying the sump, and it is intended that the undissolved, molten alloying ingredient pass downwardly from the sump floor through the refractory material permeable to that alloying ingredient and then be removed through the drain in the underlying tundish steel shell. One embodiment of the sump described in the preceding part of this paragraph is disclosed in the aforementioned U.S. Pat. No. 4,852,632

Problems have arisen in the employment of the sump described in the preceding paragraph. More particularly, the passageways in the refractory, through which the undissolved, molten alloying ingredient was supposed to pass in the course of being removed from the sump, have become plugged with solidified or cooled, viscous alloying ingredient. This prevents removal of the undissolved alloying ingredient from the tundish bottom, causing the accumulations of undissolved, molten alloying ingredient on the tundish bottom to grow larger and larger. Some of this unremoved, undissolved, molten alloying ingredient may work its way underneath the refractory dam, behind which the undissolved, molten alloying ingredient is supposed to be contained; the undissolved, molten alloying ingredient can also work its way through cracks at the bottom of the refractory dam. When those things occur, the undissolved, molten alloying ingredient can flow downstream to the tundish outlet opening, which is undesirable. In addition, there may be other ways for unremoved, undissolved, molten alloying ingredient to find its way to the tundish outlet opening, all of this being undesirable.

In another embodiment, there is one dam upstream of the passageway, between the passageway and the tundish inlet location, and other dams downstream of the passageway, between the passageway and the tundish outlet openings. These dams wall off a portion of the tundish and define a tundish holding compartment. Molten steel flows over the tops of the dams and then flows to the tundish outlet openings. Undissolved, molten alloying ingredient accumulates in the holding compartment, and one or more passageways of the type described above are provided in the holding compartment to remove the accumulations. These passageways can be in the floor of a sump, or they can be merely in the bottom of the holding compartment, outside of a sump. In the case where a holding compartment is sump-less, the entire holding compartment is tantamount to one large sump.

The problem of plugged passageways, described above in connection with a passageway located in a sump floor, is also present when passageways are located in the bottom of a holding compartment, outside of a sump. When a passageway in the holding compartment becomes plugged, the accumulations of undissolved, molten alloying ingredient in that compartment become larger and larger, and that is undesirable.

SUMMARY OF THE INVENTION

In accordance with the present invention, expedients are provided to prevent the passageways, which are permeable to the undissolved, molten alloying ingredient, from being blocked by solidified or cooled, viscous molten alloying ingredient. Structure is provided which maintains the passageways at a temperature which prevents undissolved, molten alloying ingredient which descends into a passageway from cooling to a temperature at which the alloying ingredient blocks the passageway against further passage by undissolved, molten alloying ingredients.

In one embodiment, the desired temperature is maintained by providing at least one high-conductivity, refractory brick in that part of the tundish refractory lining which underlies the sump floor or which abuts a passageway. The interior of the tundish bottom is lined with refractory, and the refractory surrounding the high-conductivity, refractory brick may be rammed refractory. In such a case, the interface between the high-conductivity, refractory brick and the rammed refractory defines one of the passageways along which undissolved, molten alloying ingredient may be removed from an accumulation at the bottom of the sump. Other such passageways are defined by the vertical joints between adjacent high-conductivity, refractory bricks which underlie the floor of the sump or which are included in that part of the refractory lining which abuts a passageway.

Preferably, at least one high-conductivity, refractory brick has a portion extending above the floor of the sump and into the molten steel contained in the tundish. With or without an extension into the molten steel, the upper part of the high-conductivity, refractory brick is heated by the molten steel in the tundish, and the high conductivity of the refractory brick conducts the heat downwardly through the brick to maintain the entire brick and each adjacent passageway at a temperature above that at which undissolved, molten alloying ingredient will solidify or become so viscous as to cause plugging of the passageway.

In another embodiment, the temperature of the high-conductivity, refractory brick underlying the floor of the sump or abutting the passageway is maintained at the desired level by employing a heating element which underlies the brick and/or extends upwardly into the brick from the bottom thereof.

The expedients for preventing plugging of a passageway located in a sump floor can also be used to prevent plugging of a passageway which is in the bottom of a holding compartment and which is not located in a sump.

The sump and/or the passageway is typically disposed on the tundish bottom at any location between the entry location and the outlet openings. In one embodiment, a sump is located immediately adjacent the downstream side of a refractory dam intended to prevent undissolved, molten alloying ingredient from moving downstream toward the tundish outlet opening. As thus located, the sump will capture undissolved molten alloying ingredient which works its way under the refractory dam or through cracks in the bottom of the refractory dam.

Other features and advantages are inherent in the structure claimed and disclosed or will become apparent to those skilled in the art from the following detailed description in conjunction with the accompanying diagrammatic drawings.

DETAILED DESCRIPTION

Figure 1:
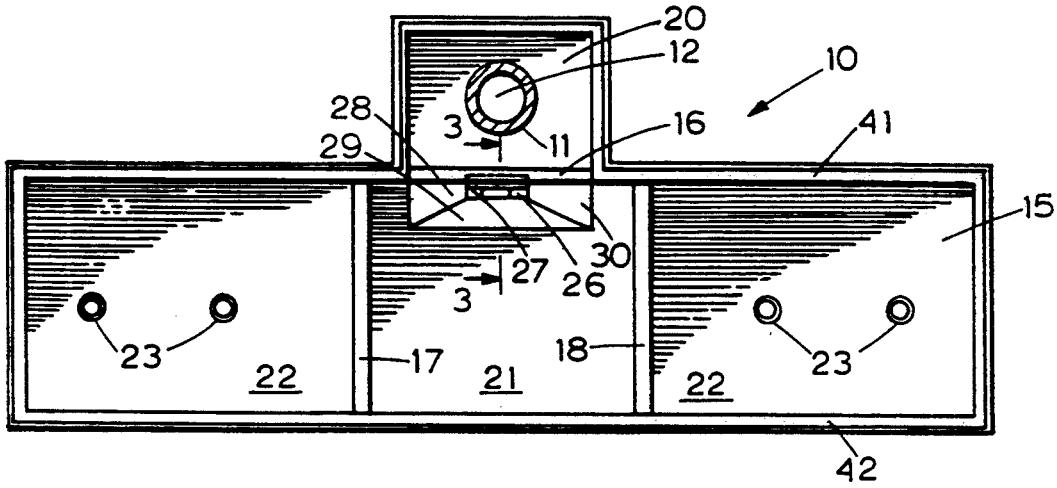
FIG. 1 is a plan view of a tundish constructed in accordance with an embodiment of the present invention.
Figure 3:
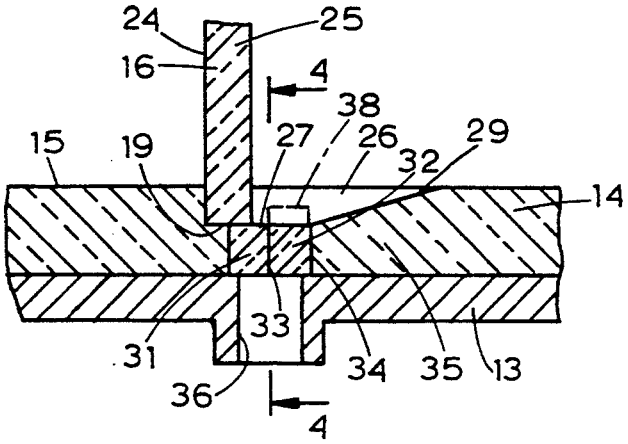
FIG. 3 is a sectional view taken along line 3—3 in FIG. 1.
Figure 4:
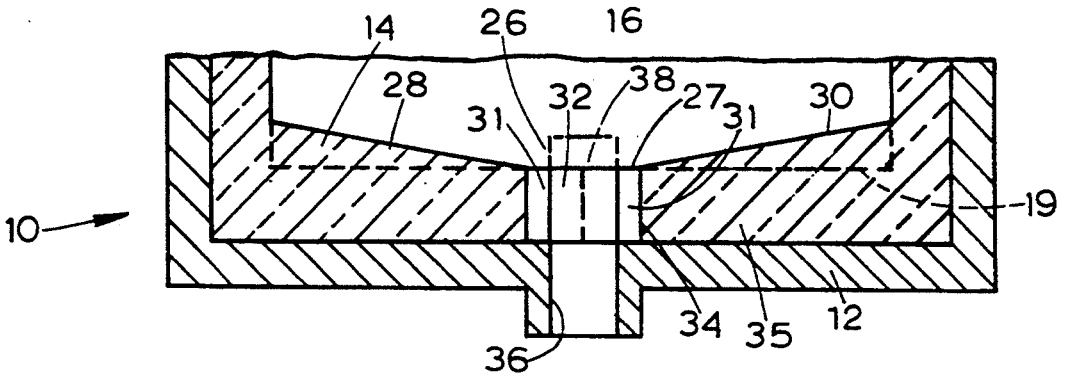
FIG. 4 is a sectional view taken along line 4—4 in FIG. 3.

Referring initially to FIG. 1, indicated generally at 10 is a tundish into which a stream of molten steel is introduced from above through a vertically disposed conduit 11 which directs the stream of molten steel into the tundish at an entry location 12. As shown in FIGS. 3 and 4, tundish 10 comprises a steel outer shell 13 and an interior refractory lining 14. The tundish comprises a bottom 15 having a plurality of outlet openings 23. Entry location 12 is spaced upstream from outlet openings 23.

As shown in FIG. 1, tundish 10 includes a plurality of vertically disposed dams 16, 17 and 18 dividing the tundish interior into a series of compartments, namely an entry compartment 20 containing entry location 12, a holding compartment 21 and a pair of outlet compartments 22 each containing a pair of outlet openings 23. Molten steel is introduced into entry compartment 20 at entry location 12, flows over dam 16 into holding compartment 21 and then flows over dams 17, 18 into outlet compartments 22 for removal through outlet openings 23.

Dam 16 is composed of refractory and is typically supported on refractory lining 14 (FIG. 3). Dams 17 and 18 may be composed of refractory-encased steel having a bottom edge which rests directly atop tundish outer steel shell 13 (not shown). Dams of this type are described in detail in Moscoe, et al. U.S. Pat. No. 4,828,014, dated May 9, 1989, and the disclosure thereof is incorporated herein by reference.

The molten steel introduced into tundish 10 may contain a molten alloying ingredient which has a density greater than the density of molten steel. Such alloying ingredients include lead and bismuth. Some of this dense, molten alloying ingredient may be undissolved in the steel, and the undissolved, molten alloying ingredient will settle to tundish bottom 15. Dams 17 and 18 are intended to minimize the entry of such undissolved, molten alloying ingredient into outlet compartments 22. This causes the undissolved, molten alloying ingredient to accumulate in holding compartment 21. More particularly, steel dams 17 and 18 have a bottom resting atop tundish outer steel shell 13. As a result, undissolved, molten alloying ingredient is prevented from passing under darns 17, 18 to outlet compartments 22; instead the undissolved, molten alloying ingredient is retained in holding compartment 21 and accumulates there in large quantities unless removed.

Undissolved, molten alloying ingredient may enter compartment 21 by flowing over the top of dam 16 with the molten steel. Other undissolved, molten alloying ingredient may work its way under dam 16, at the interface 19 between (a) the bottom of dam 16 and (b) refractory lining 14 or may penetrate through darn 16 if there are cracks in darn 16 near the bottom thereof. In addition, there may be cracks in refractory lining 14, below the bottom of dam 16, and undissolved, molten alloying ingredient can work its way from compartment 20 to compartment 21 through these cracks, unless the cracks become plugged. If these cracks are relatively close to the molten steel above tundish bottom 15, the temperature at these cracks will be high enough to prevent the undissolved, alloying ingredient passing through these cracks from plugging the cracks.

As a result of the occurrences described above, holding compartment 21 may contain a substantial amount of undissolved, molten alloying ingredient, and that is undesirable. In the absence of dams 17 and 18, some of this undissolved, molten alloying ingredient could work its way through refractory lining 14 on tundish bottom 15 to tundish outer shell 12 and from there work its way along the top surface of shell 12 to an outlet opening 23, causing the undissolved, molten alloying ingredient to flow, with the molten steel undergoing withdrawal through outlet opening 23, into a casting mold for the molten steel. For reasons described above, this is undesirable.

In order to prevent occurrences of the type described in the preceding paragraphs, and for other reasons, it is desirable to prevent large quantities of undissolved, molten alloying ingredient which settles to tundish bottom 15 in compartment 21 (or elsewhere in the tundish) from staying there. This is accomplished in accordance with the present invention, utilizing the expedients described below.

Disposed between entry location 12 and outlet openings 23, on the downstream side of dam 16, is a sump 26 in tundish bottom 15. Tundish outlet openings 23 are downstream of sump 26. Sump 26 has a floor 27 and a plurality of sides 28, 29 and 30 which slope from the interior surface of tundish bottom 15 downwardly toward sump floor 27, from a downstream direction (FIGS. 3–4). Undissolved, molten alloying ingredient, which settles to the bottom of compartment 21, tends to accumulate in sump 26; and undissolved, molten alloying ingredient which works its way past dam 16, either under the darn or through cracks near the bottom of the dam, also accumulates in sump 26. It is desirable to withdraw, from the tundish, undissolved, molten alloying ingredient which accumulates in sump 26 or compartment 21, and structure for doing so will now be described.

Refractory lining 14 has a part thereof, in the form of refractory bricks 31, 32, which underlies sump floor 27. There is at least one passageway, defined by the joint 33 between refractory bricks 31 and 32, extending between sump floor 27 and that part of metal shell 13 underlying sump 26. Joint 33 may be devoid of mortar, or joint 33 may contain mortar having a porosity which is permeable to the undissolved, molten alloying ingredient but impermeable to molten steel.

An example of a mortar composition which may be used at joint 33 comprises, in wt. %:

| | |
|---|---|
| silica ($SiO_2$) | 55.3 |
| alumina ($Al_2O_3$) | 39.2 |
| titania ($TiO_2$) | 2.0 |
| iron oxide ($Fe_2O_3$) | 1.4 |
| lime (CaO) | 0.3 |
| magnesia (MgO) | 0.4 |
| alkalies ($Na_2O + K_2O + Li_2O$) | 1.4 |

Some of the considerations relevant to the permeability of undissolved, molten alloying ingredient and the impermeability of molten steel, relative to the passageway defined by joint 33, are described in the aforementioned Jackson, et al. U.S. Pat. No. 4,852,632, and the relevant description therein is incorporated herein by reference.

Another passageway which can be permeable to undissolved, molten alloying ingredient, while being impermeable to molten steel, is at the interface 34 between a refractory brick such as 32 and that part 35 of refractory lining 14 which surrounds and is adjacent to sump 26, particularly when the refractory at 35 is a rammed refractory.

Rammed refractory 35 is sufficiently porous with respect to the undissolved, molten alloying ingredient to permit the latter to permeate through the rammed refractory to the upper part of passageway 34, for example, while preventing the molten steel from doing so. Passageways 33, 34 are unsurrounded by (1) any material (such as a steel casing) which is impermeable to undissolved, molten alloying ingredient or (2) any material which forms a barrier to the passage of undissolved, molten alloying ingredient, from (a) refractory lining 35 to (b) passageways 33 or 34. Tundish 10 includes a drain 36 in steel shell 13, below passageways 33, 34 for withdrawing, through shell 13, undissolved, molten alloying ingredient which has permeated or descended through the passageways to shell 13.

A problem can occur which prevents undissolved, molten alloying ingredient from descending along passageways 33, 34. This in turn will prevent undissolved, molten alloying ingredient from being withdrawn from sump 26. This problem arises because of the decreasing temperature between the top and bottom of a given passageway 33, 34. If the temperature anywhere along a passageway drops below the melting point of the undissolved alloying ingredient, the undissolved, molten alloying ingredient descending along the passageway can cool to a temperature at which the alloying ingredient solidifies or becomes sufficiently viscous to block the passageway against further passage by the undissolved alloying ingredient.

In accordance with the present invention, expedients are provided for maintaining each passageway 33, 34 at a temperature which prevents molten, undissolved alloying ingredient, which descends along the passageway, from cooling to a temperature which blocks the passageway against further passage by undissolved, molten alloying ingredient.

One expedient for maintaining passageways 33, 34 at the desired elevated temperature is to include, among the refractory bricks which underlie sump floor 27 and abut the passageways, at least one high-conductivity, refractory brick, e.g. brick 32. This high-conductivity, refractory brick is longitudinally disposed in a vertical direction and has an upper portion, shown in dash-dot lines at 38 in FIGS. 3–4. Upper brick portion 38 in FIGS. 3–4 preferably extends above the surrounding refractory and into the molten steel contained in the tundish. In other embodiments, each brick 31, as well as brick 32, may be composed of high-conductivity refractory, and a given high-conductivity, refractory brick 31 or 32 may or may not have an upper extended portion 38 disposed above the surrounding refractory.

The high-conductivity refractory may be of the MgO—C type or the $Al_2O_3$—MgO—C type for example. Other types of refractory may be employed for brick 31, so long as the brick has sufficient conductivity to conduct the necessary amount of heat from the overlying molten metal to the bottom of the pasageway abutted by the brick; i.e. sufficient heat must be conducted along the length of the brick to maintain an entire passageway 33 or 34 at a temperature which prevents blocking thereof by undissolved alloying ingredient. As used herein, the term "highconductivity" refers to a refractory which will perform the function described in the preceding sentence.

An example of a MgO—C type of high-conductivity refractory is set forth below, in parts:

| | |
|---|---|
| carbon (C) | 17.1 |
| silica ($SiO_2$) | 1.1 |
| alumina ($Al_2O_3$) | 0.5 |
| iron oxide ($Fe_2O_3$) | 0.3 |
| lime (CaO) | 2.2 |
| magnesia (MgO) | 95.9 |

Set forth below is an example of a rammed refractory 35 which permits undissolved, molten alloying ingredient to permeate through the rammed refractory to a passageway such as 34, while preventing molten steel from doing so. The rammed refractory comprises, in wt. %:

| | |
|---|---|
| alumina ($Al_2O_3$) | 79.1 |
| silica ($SiO_2$) | 13.4 |
| titania ($TiO_2$) | 2.4 |
| phosphorous pentoxide ($P_2O_5$) | 3.1 |
| iron oxide ($Fe_2O_3$) | 1.3 |
| alkalies | 0.2 |

Figure 2:
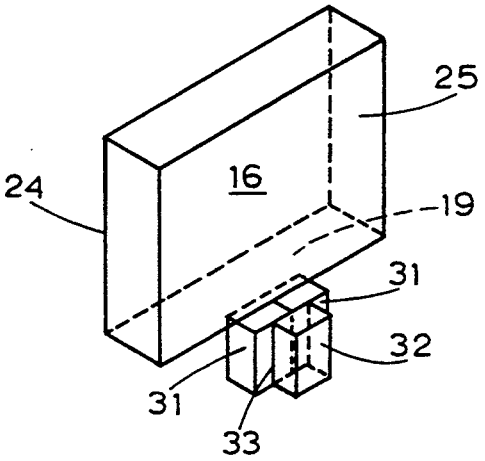
FIG. 2 is a perspective illustrating parts of the tundish of FIG. 1.

Dam 16 has an upstream side 24 and a downstream side 25, and sump 26 is located adjacent the dam's downstream side 25. As shown in FIGS. 2–3, each of refractory bricks 31 has a portion which underlies dam 16 and a portion located on the dam's downstream side 25. Refractory brick 32 is located downstream of bricks 31 and adjacent thereto. As previously noted, in one embodiment, refractory bricks 31 and 32 are all composed of high-conductivity refractory.

In the embodiment illustrated in FIGS. 1–4, sump 26 is located adjacent downstream side 25 of darn 16, but other locations may be appropriate for such a sump. The important consideration is that the sump be located between entry location 12 and outlet openings 23 so as to accumulate undissolved, molten alloying ingredient and prevent the latter from exiting through outlet openings 23.

In some embodiments, passageways such as 33, 34 can be located in the tundish bottom 15 of holding compartment 21, outside of any sump. Such passageways can be located anywhere in holding compartment 21 where the passageways will function to remove, from compartment 21, accumulations of undissolved, molten alloying ingredient.

In all embodiments, the passageways 33, 34 extend between (a) the top of refractory lining 14 on tundish bottom 15 and (b) the underlying steel shell 13. In the embodiments with a sump, the top of the refractory lining, at the location of passageways 33, 34, is at sump floor 27. There can sometimes be a thin layer of porous, refractory material sprayed atop the tundish bottom (refractory brick and/or rammed refractory) to act as a parting compound which prevents solidified, residual metal (skull) in the tundish from adhering to the refractory lining on the tundish bottom when the skull is removed from the tundish. As used herein, reference to the top of the refractory lining means the top of the refractory brick and/or the top of the rammed refractory underlying the thin, porous, sprayed-on layer (when such a layer is employed).

In all embodiments, refractory lining 14 has a part thereof which abuts passageways 33, 34, e.g. refractory bricks 31, 32 and rammed refractory 35. In the embodiments with a sump, bricks 31, 32 underlie the sump floor and rammed refractory 35 surrounds the sump.

In all embodiments having a high-conductivity, refractory brick with an upper, extended portion 38, brick portion 38 extends above the surrounding refractory. In the embodiments with a sump, brick portion 38 extends above sump floor 27.

In those embodiments having one or more discrete sumps, each such sump may be located in holding compartment 21 in a disposition parallel to dams 17, 18, on the upstream side of one of these dams, adjacent thereto or spaced therefrom. Such a sump may be elongated in the longitudinal direction of the dam, or the sump may be unelongated. In other embodiments, a sump disposed in a parallel relation to a darn 17 or 18 could be located on the downstream side of the dam so long as it was upstream of an adjacent pair of outlet openings 23. Similarly, in a tundish without dams such as 17 or 18, the sump can be longitudinally disposed between walls 41, 42 of the tundish, downstream of inlet location 12 and upstream of outlet openings 23. Such a disposition is shown at 46 in FIG. 5.

Figure 5:
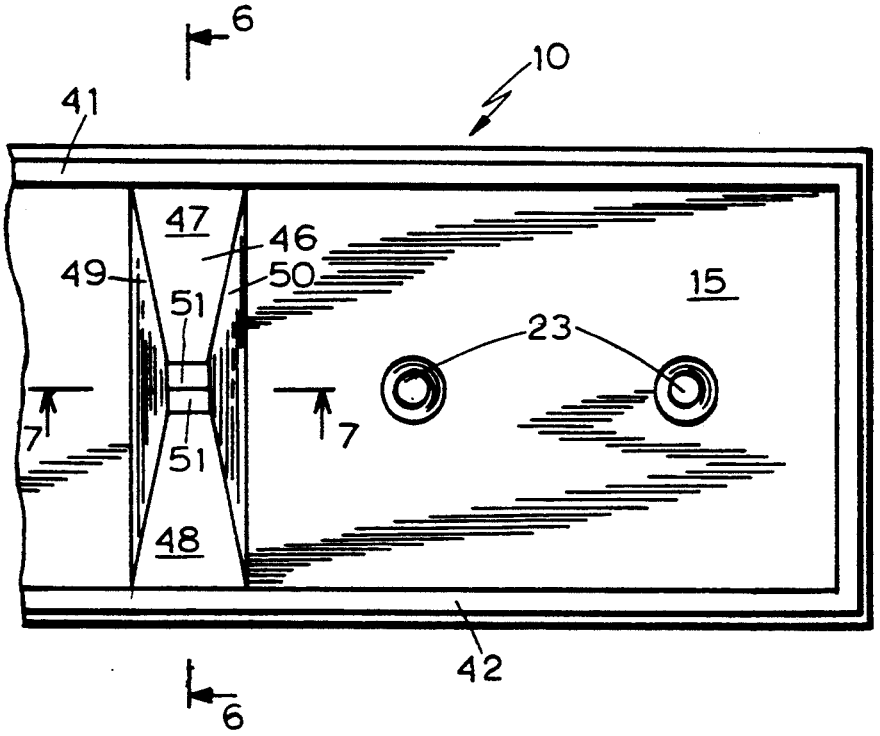
FIG. 5 is a fragmentary plan view of another embodiment of a tundish constructed in accordance with the present invention.

The sump shown at 46 in FIG. 5 can be employed in a tundish which does or does not have dams such as 17, 18, and when employed with a tundish having dams 17, 18, the sump can be located either on the upstream side of the dam or on the downstream side of the dam.

Figure 6:
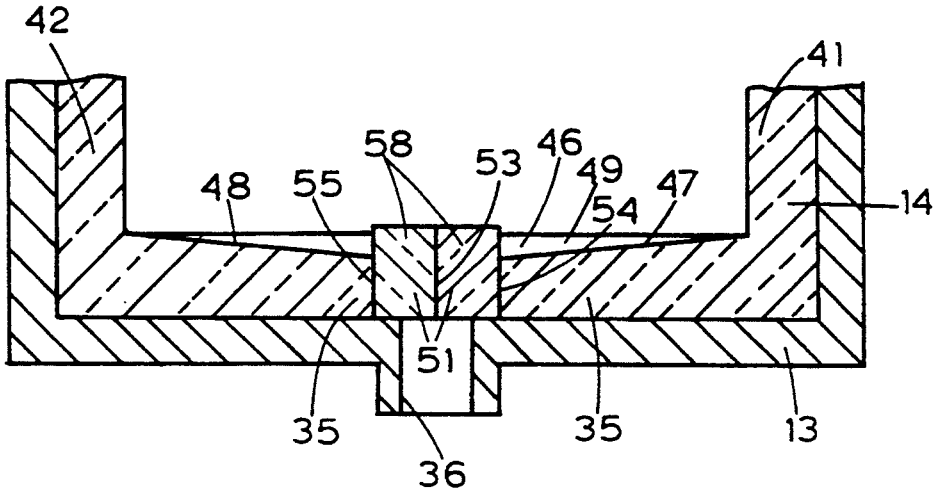
FIG. 6 is a sectional view taken along line 6—6 in FIG. 5.
Figure 7:
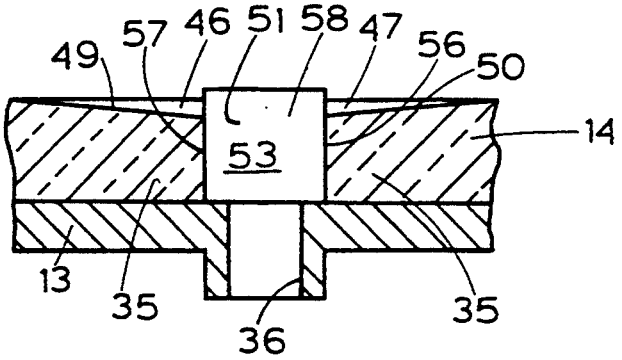
FIG. 7 is a fragmentary, sectional view taken along line 7—7 in FIG. 5.

Referring to FIGS. 5–7, sump 46 extends between tundish sidewalls 41, 42 and is located upstream of outlet openings 23 and downstream of inlet location 12 (not shown in FIGS. 5–7). Sump 46 comprises a downstream side 50 which may slope toward the sump floor from a downstream direction and an upstream side 49 which may slope toward the floor of sump 46 from an upstream direction. Sump 46 may have a total of four sloping sides, 47, 48, 49 and 50, which converge in a downward direction toward a pair of high-conductivity refractory bricks 51, 51. In sump 46, the sump floor is defined by the lower parts of sloping sump sides 47–50. The passageways which extend between the floor of sump 46 and the underlying steel shell 13 are defined by the joint 53 between high-conductivity refractory bricks 51, 51, and by the interfaces 54, 55, 56 and 57 between (a) bricks 51, 51 and (b) rammed refractory 35 which is disposed around highconductivity refractory bricks 51, 51.

Passageways 53–57 are maintained at a temperature which prevents undissolved, molten alloying ingredient, which descends along these passageways, from cooling to a temperature at which the alloying ingredient becomes solidified or sufficiently viscous to block the passageway against further passage by the undissolved alloying ingredient. This is accomplished by the upper portion 58 of each high-conductivity, refractory brick 51. Upper brick portion 58 may extend above the floor of sump 46 and into the molten steel contained in the tundish, thereby heating upper brick portion 58 sufficiently to maintain the desired elevated temperature from the top to the bottom of each of the passageways 53–57.

Figure 8:
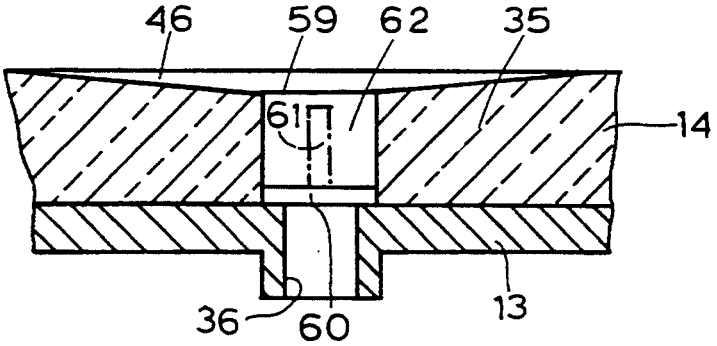
FIG. 8 is a fragmentary, sectional view, similar to FIG. 7, illustrating a variation of the embodiments of the other Figures.

Another expedient for maintaining the passageways at the desired elevated temperature is illustrated in FIG. 8. In this embodiment, the top of each of a plurality of refractory bricks 62 is no higher than the floor 59 of sump 46. Refractory brick 62 is preferably composed of high-conductivity refractory. That part of refractory brick 62 which underlies sump floor 59 or which abuts a passageway is heated by a heating element, e.g. an electrical heating element, typically comprising a substantially horizontally disposed member 60 underlying brick 62 which is in contacting relation with the top of heating member 60. In lieu of member 60, or in combination therewith, the heating element may comprise a substantially vertically disposed member 61 extending upwardly into refractory brick 62. In those instances where the heating element at 60, 61 is an electrical heating element, heating member 60 and/or heating member 61 may be connected to a source of electrical energy in a conventional manner (not shown). Members 60, 61 may be composed of copper or other conductors conventionally utilized as heating elements under comparable external temperature conditions.

In other embodiments, electrical heating of members 60, 61 may be replaced by flame heating of these members from below, or by direct flame heating of the bottom of refractory brick 62, without employing member 60 and with or without member 61. In still other embodiments brick 62 may be provided with a vertical opening where member 61 is located, and a flame may be directed upwardly into that opening.

The expedients for heating refractory brick 62, shown in FIG. 8 or otherwise described above, may also be employed to heat refractory bricks 31–32 shown in FIGS. 2–4 or to heat refractory bricks 51 shown in FIGS. 6–7. In such cases, no refractory brick need extend above the sump floor, although it may. In the embodiments of FIGS. 2–4 and 6–7, the top of a high-conductivity, refractory brick need not extend above the surrounding refractory (e.g. the sump floor) if, when the brick top is flush with the surrounding refractory, sufficient heat is conducted from the overlying molten metal to the bottom of the brick so as to keep the abutting passageways from being blocked by undissovled alloying ingredient.

Except for the differences described above, sump 46 and its associated structure is essentially the same as sump 26 and its associated structure. The upper portion 38 of high-conductivity, refractory brick 32, and the upper portion 58 of highconductivity, refractory bricks 51 extend upwardly into the molten metal within the tundish to provide good thermal contact with the molten steel. The sides of sumps 26 and 46 are sloped downwardly so that undissolved, molten alloying ingredient will collect or accumulate around the upper end of passageways 33, 34 and 53–57.

The foregoing detailed description has been given for clearness of understanding only and no unnecessary limitations should be understood therefrom, as modifications will be obvious to those skilled in the art.

What is claimed is:

1. A tundish for use in the continuous casting of a molten alloy containing a molten alloying ingredient having a density greater than that of the molten alloy as a whole, said tundish comprising:

a metal outer shell and an interior refractory lining;

a tundish bottom having an outlet opening;

means for receiving a stream of said molten alloy within said tundish at an entry location spaced upstream from said outlet opening;

means, located between said entry location and said outlet opening, for accumulating the molten alloying ingredient which is undissolved in said molten alloy;

means defining at least one passageway extending between (a) the top of the refractory lining on the tundish bottom and (b) that part of the metal shell underlying said refractory lining;

said refractory lining having a part thereof which abuts a passageway;

said passageway being positioned at a location where said undissolved, molten alloying ingredient accumulates;

said passageway being permeable to said undissolved, molten alloying ingredient but impermeable to said molten alloy;

means for maintaining said passageway at a temperature which prevents undissolved, molten alloying ingredient, which descends along the passageway, from cooling to a temperature at which the undissolved alloying ingredient blocks the passageway against further passage by said undissolved alloying ingredient;

and drain means in said outer shell, below said passageway, for withdrawing, through said shell, molten, undissolved alloying ingredient which has permeated through the passageway to said shell.

2. A tundish as recited in claim 1 wherein:

said temperature-maintaining means comprises at least one high-conductivity, refractory brick in that part of said refractory lining which abuts a passageway;

said high-conductivity, refractory brick is longitudinally disposed in a vertical direction and has an upper portion extending above the surrounding refractory and into the molten steel contained in said tundish.

3. A tundish as recited in claim 1 wherein:

that part of said refractory lining which abuts a passageway comprises a plurality of adjacent refractory bricks separated by a vertical joint which defines a first passageway.

4. A tundish as recited in claim 1 wherein said temperature-maintaining means comprises:

a heating element for heating a part of said refractory lining which abuts a passageway.

5. A tundish as recited in claim 4 wherein:

said heating element comprises a substantially horizontally disposed member underlying at least a portion of that part of said refractory lining which abuts a passageway.

6. A tundish as recited in claim 5 wherein:

that part of said refractory lining which abuts a passageway comprises a refractory brick in contacting relation with and disposed atop said member.

7. A tundish as recited in claim 4 wherein:

said heating element comprises a substantially vertically disposed member extending upwardly into that part of said refractory lining which abuts a passageway.

8. A tundish as recited in claim 7 wherein:

that part of said refractory lining which abuts a passageway comprises a refractory brick;

and said member extends upwardly into said refractory brick.

9. A tundish as recited in claim 6 or 8 and comprising:

rammed refractory disposed around and adjacent said refractory brick;

said passageway being defined by the interface between said refractory brick and said rammed refractory;

said rammed refractory comprising means which permits said undissolved molten alloying ingredient to permeate through the rammed refractory to said passageway while preventing said molten alloy from doing so.

10. A tundish as recited in claim 1 wherein:

said tundish comprises a slump in said tundish bottom;

said sump has a floor and comprises means for accumulating said undissolved, molten alloying ingredient;

said passageway extends downwardly from said sump floor;

a part of said refractory lining underlies said sump floor;

said tundish outlet opening is located downstream of said sump;

and said sump comprises a downstream side which slopes toward said sump floor from a downstream direction.

11. A tundish as recited in claim 10 wherein:

said entry location is upstream of said sump;

and said sump comprises an upstream side which slopes toward said sump floor from an upstream direction.

12. A tundish as recited in claim 10 and comprising:

a first dam extending upwardly from the tundish bottom between said entry location and said tundish outlet opening;

said dam having an upstream side and a downstream side;

said sump being located adjacent said downstream side of the dam;

and a second dam downstream of said sump and upstream of said outlet opening;

said second darn comprising means for preventing undissolved, molten alloying ingredient from passing downstream of said second dam.

13. A tundish as recited in claim 12 wherein:

that part of said refractory lining which underlies said sump floor comprises a plurality of bricks each having a portion which underlies said dam and a portion located on the downstream side of said dam.

14. A tundish as recited in claim 13 and comprising:

an additional refractory brick located downstream of said plurality of bricks and adjacent thereto.

15. A tundish as recited in claim 14 wherein:

said additional refractory brick and said plurality of refractory bricks are all composed of high conductivity refractory.

16. A tundish as recited in claim 14 or 15 wherein:

said additional refractory brick is longitudinally disposed in a vertical direction and has an upper portion which extends above the sump floor and into the molten steel contained in said tundish.

17. A tundish as recited in claim 1 wherein:

that part of said refractory lining which abuts said passageway comprises a plurality of adjacent refractory bricks separated by a vertical joint which defines a first passageway;

said tundish comprising rammed refractory disposed around and adjacent said refractory bricks;

and at least one of said passageways is located at the interface between one of said refractory bricks and said rammed refractory.

18. A tundish as recited in claim 17 wherein said temperature-maintaining means comprises:

a heating element for heating that part of said refractory lining which abuts a passageway.

19. A tundish as recited in claim 18 wherein:

said heating element comprises a substantially horizontally disposed member underlying one of said refractory bricks;

said one refractory brick is in contacting relation with and disposed atop said member;

and said one refractory brick is adjacent one of said passageways.

20. A tundish as recited in claim 18 or 19 wherein:

said heating element comprises a substantially vertically disposed member extending upwardly into one of said refractory bricks;

and said one refractory brick is adjacent one of said passageways.

21. A tundish as recited in claim 20 wherein:

said one refractory brick is composed of highconductivity refractory.

22. A tundish as recited in claim 1 wherein:

said passageway is unsurrounded by any material which is impermeable to undissolved, molten alloying ingredient and which forms a barrier to the passage of undissolved alloying ingredient from (a) the refractory lining surrounding and adjacent said passageway to (b) said passageway.

23. A tundish as recited in claim 1 and comprising:

dam means defining a holding compartment downstream of said entry location and upstream of said outlet opening;

said darn means comprising means for preventing undissolved, molten alloying ingredient from reaching said outlet opening;

said passageway being located in said holding compartment.

24. A tundish as recited in claim 1 or claim 23 and comprising:

a sump in said tundish bottom;

said sump having a floor and comprising means for accumulating said undissolved, molten alloying ingredient;

said passageway extending downwardly from said sump floor.

25. A tundish for use in the continuous casting of a molten alloy containing a molten alloying ingredient having a density greater than that of the molten alloy as a whole, said tundish comprising.

a metal outer shell and an interior refractory lining;

a tundish bottom having an outlet opening;

means for receiving a stream of said molten alloy within said tundish at an entry location spaced upstream from said outlet opening;

means, located between said entry location and said outlet opening, for accumulating the molten alloying ingredient which is undissolved in said molten alloy;

means defining at least one passageway extending between (a) the top of the refractory lining on the tundish bottom and (b) that part of the metal shell underlying said refractory lining;

said refractory lining having a part thereof which abuts a passageway;

said passageway being positioned at a location where said undissolved, molten alloying ingredient accumulates;

said passageway being permeable to said undissolved, molten alloying ingredient but impermeable to said molten alloy;

means for maintaining said passageway at a temperature which prevents undissolved, molten alloying ingredient, which descends along the passageway, from cooling to a temperature at which the undissolved alloying ingredient blocks the passageway against further passage by said undissolved alloying ingredient;

and drain means in said outer shell, below said passageway, for withdrawing, through said shell, molten, undissolved alloying ingredient which has permeated through the passageway to said shell;

said part of said refractory lining which abuts a passageway comprising a plurality of adjacent refractory bricks separated by a vertical joint which defines a first passageway;

at least one said refractory bricks being composed of high-conductivity refractory.

26. A tundish as recited in claim 25 wherein:

said high conductivity refractory brick is longitudinally disposed in a vertical direction and has an upper portion extending above the top of the surrounding refractory and into the molten steel contained in said tundish.

27. A tundish as recited in claim 25 and comprising:

rammed refractory disposed around and adjacent said high-conductivity refractory brick.

28. A tundish as recited in claim 27 wherein:

at least one of said passageways is located at the interface between said high conductivity refractory brick and said ranched refractory;

said rammed refractory comprising means which permits said undissolved, molten alloying ingredient to permeate through the ranched refractory to said one passageway while preventing said molten alloy from doing so.

29. A tundish as recited in claim 28 wherein said temperature-maintaining means comprises:

a substantially vertically disposed, heating member extending upwardly into one of said refractory bricks abutting a passageway.

30. A tundish for use in the continuous casting of a molten alloy containing a molten alloying ingredient having a density greater than that of the molten alloy as a whole, said tundish comprising:

a metal outer shell and an interior refractory lining;

a tundish bottom having an outlet opening;

means for receiving a stream of said molten alloy within said tundish at an entry location spaced upstream from said outlet opening;

means, located between said entry location and said outlet opening, for accumulating the molten alloying ingredient which is undissolved in said molten alloy;

means defining at least one passageway extending between (a) the top of the refractory lining on the tundish bottom and (b) that part of the metal shell underlying said refractory lining;

said refractory lining having a part thereof which abuts a passageway;

said passageway being positioned at a location where said undissolved, molten alloying ingredient accumulates;

said passageway being permeable to said undissolved, molten alloying ingredient but impermeable to said molten alloy;

means for maintaining said passageway at a temperature which prevents undissolved, molten alloying ingredient, which descends along the passageway, from cooling to a temperature at which the undissolved alloying ingredient blocks the passageway against further passage by said undissolved alloying ingredient;

and drain means in said outer shell, below said passageway, for withdrawing, through said shell, molten, undissolved alloying ingredient which has permeated through the passageway to said shell;

said part of said refractory lining which abuts said passageway comprising a plurality of adjacent refractory bricks separated by a vertical joint which defines a first passageway;

said tundish comprising rammed refractory disposed around and adjacent said refractory bricks;

at least one of said passageways being located at the interface between one of said refractory bricks and said rammed refractory;

at least one of said refractory bricks being composed of high-conductivity refractory.

31. A tundish as recited in claim 30 wherein:

said high-conductivity, refractory brick is longitudinally disposed in a vertical direction and has an upper portion extending above the top of the surrounding refractory and into the molten steel contained in said tundish.

32. A tundish for use in the continuous casting of a molten alloy containing a molten alloying ingredient having a density greater than that of the molten alloy as a whole, said tundish comprising:

a metal outer shell and an interior refractory lining;

a tundish bottom having an outlet opening;

means for receiving a stream of said molten alloy within said tundish at an entry location spaced upstream from said outlet opening;

means, located between said entry location and said outlet opening, for accumulating the molten alloying ingredient which is undissolved in said molten alloy;

means defining at least one passageway extending between (a) the top of the refractory lining on the tundish bottom and (b) that part of the metal shell underlying said refractory lining;

said refractory lining having a part thereof which abuts a passageway;

said passageway being positioned at a location where said undissolved, molten alloying ingredient accumulates;

said passageway being permeable to said undissolved, molten alloying ingredient but impermeable to said molten alloy;

means for maintaining said passageway at a temperature which prevents undissolved, molten alloying ingredient, which descends along the passageway, from cooling to a temperature at which the undissolved alloying ingredient blocks the passageway against further passage by said undissolved alloying ingredient;

drain means in said outer shell, below said passageway, for withdrawing, through said shell, molten, undissolved alloying ingredient which has permeated through the passageway to said shell;

dam means defining a holding compartment downstream of said entry location and upstream of said outlet opening;

said dam means comprising means for preventing undissolved, molten alloying ingredient from reaching said outlet opening;

said passageway being located in said holding compartment;

and a sump in said tundish bottom;

said sump having a floor and comprising means for accumulating said undissolved, molten alloying ingredient;

said passageway extending downwardly from said sump floor;

said part of said refractory lining which abuts said passageway comprising a high-conductivity, refractory brick.

33. A tundish for use in the continuous casting of a molten alloy containing a molten alloying ingredient having a density greater than that of the molten alloy as a whole, said tundish comprising:

a metal outer shell and an interior refractory lining;

a tundish bottom having an outlet opening;

means for receiving a stream of said molten alloy within said tundish at an entry location spaced upstream from said outlet opening;

means, located between said entry location and said outlet opening, for accumulating the molten alloying ingredient which is undissolved in said molten alloy;

means defining at least one passageway extending between (a) the top of the refractory lining on the tundish bottom and (b) that part of the metal shell underlying said refractory lining;

said refractory lining having a part thereof which abuts a passageway;

said passageway being positioned at a location where said undissolved, molten alloying ingredient accumulates;

said passageway being permeable to said undissolved, molten alloying ingredient but impermeable to said molten alloy;

means for maintaining said passageway at a temperature which prevents undissolved, molten alloying ingredient, which descends along the passageway, from cooling to a temperature at which the undissolved alloying ingredient blocks the passageway against further passage by said undissolved alloying ingredient;

drain means in said outer shell, below said passageway, for withdrawing, through said shell, molten, undissolved alloying ingredient which has permeated through the passageway to said shell;

and a sump is said tundish bottom;

said sump having a floor and comprising means for accumulating said undissolved, molten alloying ingredient;

said passageway extending downwardly from said sump floor;

said part of said refractory lining which abuts said passageway comprising a high-conductivity refractory brick.

34. A tundish as recited in any of claims 25, 30, 32 or 33 wherein said high conductivity refractory brick comprises:

means for conducting sufficient heat, when molten steel containing said undissolved alloying ingredients overlies said brick, to maintain said passageway at a temperature which prevents blocking thereof by an undissolved alloying ingredient when the latter is lead or bismuth.

* * * * *

UNITED STATES PATENT AND TRADEMARK OFFICE

CERTIFICATE OF CORRECTION

PATENT NO. : 5,338,009

DATED : August 16, 1994

INVENTOR(S) : Howard M. Pielet, William J. Kreevich, Masood A. Tindyala and John R. Knoepke It is certified that error appears in the above-indentified patent and that said Letters Patent is hereby corrected as shown below:

Col. 1, line 62, "darn" should be --dam--.

Col. 5, line 4, "darns" should be --dams--.

Col. 5, line 13, "darn" should be --dam--.

Col. 5, line 14, "darn" should be --dam--.

Col. 5, line 56, "darn" should be --dam--.

Col. 7, line 21, "highconductivity" should be --high-conductivity--.

Col. 7, line 58, "darn" should be --dam--.

Col. 8, line 37, "darn" should be --dam--.

Col. 8, line 67, "highconductivity" should be --high-conductivity--.

Col. 9, line 64, "highconductivity" should be --high-conductivity--.

UNITED STATES PATENT AND TRADEMARK OFFICE

CERTIFICATE OF CORRECTION

PATENT NO. : 5,338,009

DATED : August 16, 1994

INVENTOR(S) : Howard M. Pielet, William J. Kreevich, Masood A. Tindyala and John R. Knoepke It is certified that error appears in the above-indentified patent and that said Letters Patent is hereby corrected as shown below:

Col. 11, line 56, "darn" should be --dam--.

Col. 12, line 38, "highconductivity" should be --high-conductivity--.

Col. 12, line 51, "darn" should be --dam--.

Col. 13, line 52, "ranched" should be --rammed--.

Col. 13, line 55, "ranched" should be --rammed--.

Signed and Sealed this

Thirtieth Day of April, 1996

*Attest:*

*Attesting Officer*

BRUCE LEHMAN

*Commissioner of Patents and Trademarks*